US005181583A

United States Patent [19]

Platt

[11] Patent Number: 5,181,583

[45] Date of Patent: Jan. 26, 1993

[54] LADDER-LIKE STILTS FOR CEILING WORK

[76] Inventor: Stuart M. Platt, P.O. Box 108, Burgin, Ky. 40310

[21] Appl. No.: 793,621

[22] Filed: Nov. 18, 1991

[51] Int. Cl.[5] ..... E06C 1/38; A63B 25/00

[52] U.S. Cl. ..... 182/129; 182/112; 182/230

[58] Field of Search ..... 182/230, 129, 134, 112

[56] References Cited

U.S. PATENT DOCUMENTS

| | | | |
|---|---|---|---|
| 1,190,421 | 7/1916 | Kalcy . | |
| 1,467,245 | 9/1923 | Anlauf | 182/104 |
| 1,905,112 | 4/1933 | Lang . | |
| 1,930,363 | 10/1933 | Knox | 272/70.1 |
| 2,292,074 | 8/1942 | Hawk | 36/7.5 |
| 2,772,927 | 12/1956 | Woodward | 182/134 |
| 3,010,535 | 11/1961 | Depiano | 182/129 |
| 3,346,882 | 10/1967 | Wilhoyte | 182/230 |
| 4,255,822 | 3/1981 | Dixon | 272/70.2 |

*Primary Examiner*—Reinaldo P. Machado
*Attorney, Agent, or Firm*—Jones, Askew & Lunsford

[57] ABSTRACT

A ladder-like stilt, designed to be used in pairs, particularly for ceiling work such as sheetrocking as shown. Two pairs of side rails are joined at a conventional head step area. The area of the otherwise conventional head step is extended by the employment of an elongated head step platform to which a boot is attached for accepting the user's foot. The downwardly projection of the head step platform falls within the footing defined by the distal ends of the side rails, thus providing a stable platform for standing, when the stilts are used in pairs. The boot allows the user to walk on the stilts and perform elevated work, while being able to quickly dismount and climb down the steps.

11 Claims, 3 Drawing Sheets

LADDER-LIKE STILTS FOR CEILING WORK

TECHNICAL FIELD

The present invention relates to stilt devices for allowing a worker to become elevated and work on a ceiling while retaining basic walking mobility.

BACKGROUND OF THE INVENTION

Since mankind undertook the construction of buildings, people have devised various ways to elevate workers to work on surfaces that they could not reach standing on the floor or the ground. For many years, various forms of scaffolding have been known as a mechanism for providing elevated surfaces upon which people can work. Scaffolding possesses the general advantages of relative stability and the ability to significantly elevate the worker. It is well known that one of the fundamental disadvantages of scaffolding is the difficulty of moving same horizontally. In order to provide horizontal movement (i.e., in a plane parallel to the ground or floor) of the worker, the scaffolding must be made larger, or else smaller sections of scaffolding must be moved, a job which often requires disassembly. Step ladders have the advantage of relative ease of movement but they allow very little horizontal movement while the worker is mounted on the ladder due to the danger of taking the worker's center of gravity outside the footing of the ladder.

Workers who need to be elevated, particularly those finishing sheet rock on the ceilings of residential buildings, have come to use what are known as utility stilts or sheetrocker's stilts. Such stilts are constructed in the form of an elongated parallelogram with a high friction pad or shoe at the bottom and a boot or other receptacle for a person's shoe at the top. The parallelogram is normally spring loaded to allow some flexing in the manner of a parallel linkage, but is semi rigid and strongly loaded so that the worker will not fall. An example of sheetrocker's stilts may be seen in the disclosure of U.S. Pat. No. 4,255,822 to Dixon.

While sheetrocker's stilts have great utility and are commonly used throughout the United States, they have several drawbacks. First, the stilts are expensive, currently costing around $250 to $300 U.S. per pair. There is a fairly long learning curve for learning how to comfortably use sheetrocker's stilts. Additionally, because of their construction, it is necessary to assure that the feet of the user are tightly and securely bound to the top platform of the stilts. This normally leads to a relatively time consuming and laborious task of securing the boots or shoes of the user to the upper platforms of the stilts. Once the user has mounted the stilts and succeeding in standing upright, the stilts provide great lateral mobility. However, the task of dismounting the stilts is time consuming. Also, it is very beneficial to have the assistance of a wall or elevated surface for temporary support as the user lowers himself or herself to the ground to dismount the stilts.

As many sheetrockers know, dropping a tool while mounted on sheetrocker stilts is extremely annoying because of the physical labor involved and the time consumed in dismounting the stilts to retrieve the tool and remounting them via a complementary operation.

Thus, there have been some fundamental tradeoffs involved in using the worker elevation devices of the prior art. Generally, there is a tradeoff between vertical and lateral mobility. Conventional sheetrocker's stilts provide good lateral mobility to the worker. However, it is a difficult and laborious job to mount and dismount the stilts. Therefore, vertical mobility is limited. As noted above, problems such as the dropping of tools, or the need to temporarily suspend work, for example, to visit the restroom, can be annoying inconveniences that result from the lack of vertical mobility when using such stilts.

On the other hand, scaffolding provides good vertical mobility in that it is easy to mount and dismount scaffolding vertically. However, in order to provide lateral mobility, the movement of the scaffolding and disassembly and reassembly of same is problematic. In order to provide both, large arrays of scaffolding must be built which inhibit the ability of other workers to move through and work in the area occupied by the scaffolding.

The prior art has developed other forms of stilt and jack devices for elevating workers. For example, U.S. Pat. No. 1,930,363 to Knox shows a pair of jacks that elevate a worker. However, they provide only a modest increase in elevation.

U.S. Pat. No. 2,292,074 to Hawk shows what it calls a "foot scaffold". It provides a relatively stable wide footing and significant elevation. However, the mounting of same, particularly raising one's self to the elevated position using such a device, appears difficult.

U.S. Pat. No. 1,190,421 to Kalcy shows a jack device with a boot on top. There is an elongated handle for operating a pawl which raises a rectangular frame connected to a rack. This allows the user to jack himself up or down. However, the footprint of each such jack is only nominally larger than the footprint of the user's shoe. Also, U.S. Pat. No. 1,905,112 shows a fruit picker's stilt with an elongated arcuate rocker foot.

There is a need in the art to overcome the fundamental tradeoffs cited above. In particular, there is a need for a worker elevating device which provides the lateral mobility of sheetrocker stilts but still allows the worker to mount and dismount relatively quickly. Additionally, it is desirable to have such a device provide elevation that is comparable to that achieved with conventional sheetrocker stilts to allow sheetrock finishing work to be done on conventional residential housing as it is currently built in the United States of America. It is desirable that such a device be lightweight and relatively inexpensive, yet provide a stable and mobile working surface.

SUMMARY OF THE PRESENT INVENTION

The present invention fulfills the above-cited needs. Generally stated, the present invention constitutes a ladder-like stilt device. It is designed, as are stilts, to be used in pairs, one attached to each foot of the worker. The invention comprises two pairs of side rails, one having at least one step, and preferably a plurality of steps placed therebetween along the lengths of the side rails. A second pair of side rails is braced. The two side rail pairs are connected to a head step area and thus, a subcombination of the structure forms an apparatus quite similar to a conventional step stool. However, the head step area is elongated at least along an axis which passes between the members of the pairs of side rails. A boot for holding the workers foot in place is attached to the top of the elongated head step platform.

The head step platform is preferably positioned so that its projection onto the floor, when the device is in use, lies well within the footprint defined by the distal ends of the side rails, which distal ends form the feet of each stilt. Therefore, the present invention provides a simple apparatus. Placing a pair of them before the user allows the user to mount the pair of stilts by stepping up the steps between the first mentioned pairs of side rails. The user can then step on the elongated head step platform and successively urge each one of his or her feet into the boot on each of the ladder-like stilt devices constituting the present invention. When this is accomplished, the user has a stable platform upon which to rest his or her feet. The side rails preferably meet at the head step area to form an acute angle, as in a conventional step stool. Thus, the footing defined by the distal ends of the side rails is relatively large as compared to the head step platform but still small enough to allow a close approach, head on, to a vertical wall.

In the preferred form of the present invention, the boot is an open boot such as the upper portion of a boot commonly used on a water ski. This allows the user to slide his or her feet in and out, yet allows the boot to snugly hold the user's foot on to the platform. It allows the user to walk with the stilts without having to secure any straps or utilize any device providing locking engagement. Also, the preferred form of the apparatus does not require any special shoes to be worn by the user.

In its most preferred form, the ladder-like stilt device will fold in a manner similar to a conventional step stool when it is not in use making it easy to transport.

It is an object of the present invention to provide an improved stilt, particularly one suited for use by sheetrockers, which overcome the drawbacks of the prior art cited hereinabove.

It is also an object of the present invention to provide a ladder-like stilt which has the basic form of the conventional step stool with an elongated head step area and a boot mounted thereto for securing the foot of the user to the stilt.

It is a further object of the present invention to provide a set of stilts usable by sheetrockers and other workers requiring elevation which can be manufactured and sold very inexpensively as compared to conventional sheetrocker stilts.

It is still a further object of the present invention to provide an improved stilt apparatus which provides the lateral mobility of conventional sheetrocker stilts and significantly improved vertical mobility allowing the user to quickly mount and dismount the stilts in order to move the user's position, retrieve tools, obtain additional mud and tape, and similar tasks which require dismounting from the elevated working position.

That the present invention accomplishes these objects and overcomes the above described disadvantages of the prior art will be appreciated from the detailed description of the preferred embodiment below.

DETAILED DESCRIPTION OF THE PREFERRED EMBODIMENT

Figure 1:
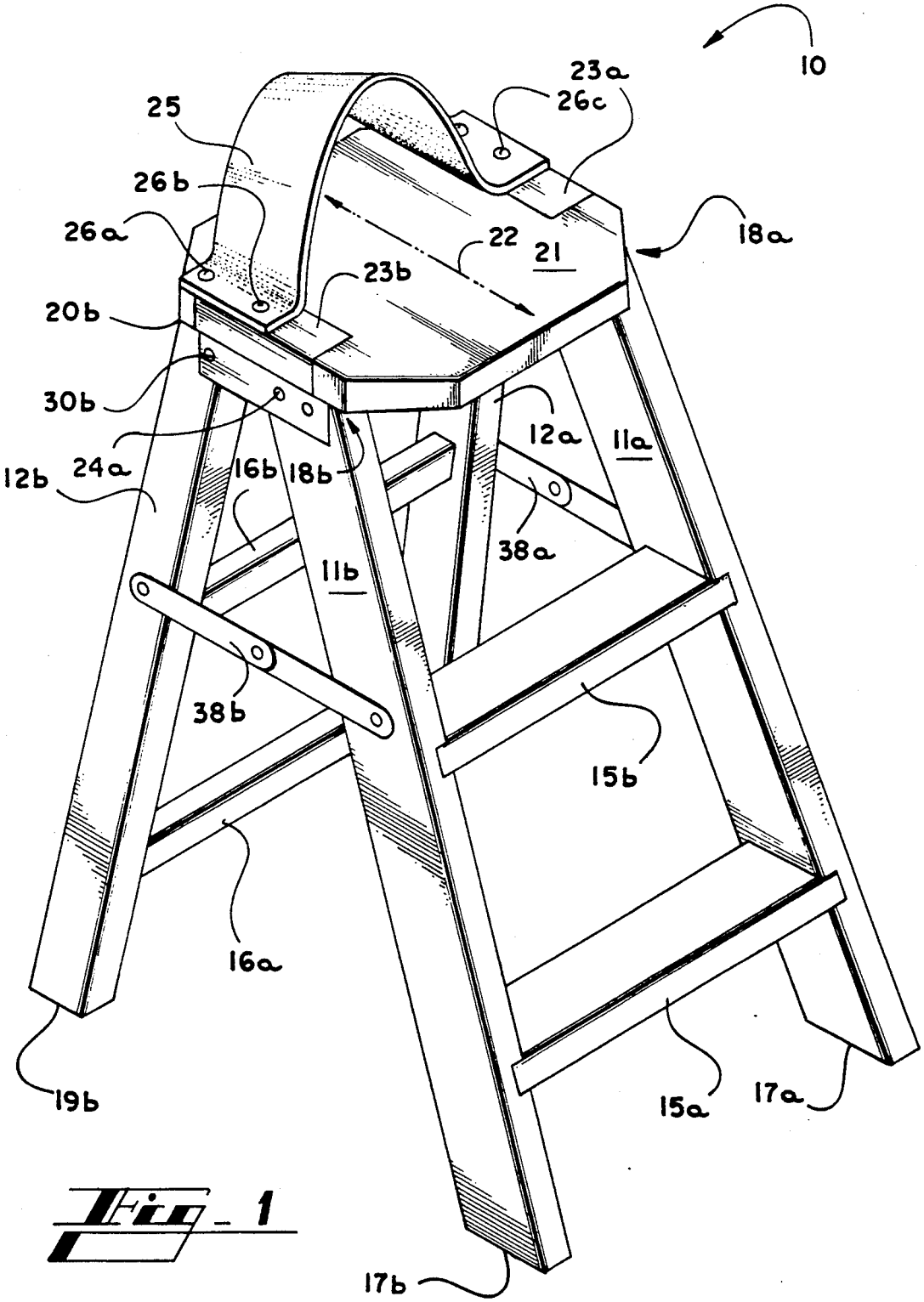
FIG. 1 is a pictorial view of the preferred embodiment of the present invention.

Turning now to the drawing figures in which like numerals represent like parts, the preferred embodiment of the present invention will now be described. FIG. 1 is a pictorial view of the preferred embodiment of the present invention, generally indicated at 10. As noted hereinabove, the present invention is designed to be used in pairs. The stilt comprises a first pair of side rails 11*a* and 11*b* having a plurality of steps 15*a* and 15*b* extending between the side rails along the lengths thereof. A second pair of side rails 12*a* and 12*b* are braced by braces 16*a* and 16*b*. As can be seen in FIG. 1, the members of the first and second pairs of side rails form an acute angle between each other. Side rails 11*a* and 11*b* have respective distal ends 17*a* and 17*b* and proximal ends 18*a* and 18*b*. Thus, in this specification, reference to proximal ends of side rails refers to the rails most closely adjacent to the top of the stilt when it is positioned for normal use.

Similarly, second pair of side rails 12*a* and 12*b* have respective distal ends 19*a* (not shown in FIG. 1) and 19*b* and proximal ends 20*a* (not shown in FIG. 1) and 20*b*.

Proximal ends 18 and 20 are connected to head step platform 21. It may be seen that head step platform 21 is elongated along a foot axis indicated at 22 in FIG. 1. On top of the head step platform 21, a boot 25 is attached. In the preferred embodiment the boot is through bolted to head step platform 21 by four bolts, three of which are shown as 26*a*–26*c* in FIG. 1. These are preferably secured by wing nuts (not shown in FIG. 1).

Boot 25 is characterized by an open end having a foot insertion axis which is colinear with foot axis 22. Thus, it should be understood that the axis defined by dashed line 22 constitutes both the foot axis of head step platform 21 and the foot insertion axis for boot 25.

A pair of aluminum brackets 23*a* and 23*b* are used to attach head step platform 21 to side rails 11 and 12. The rear side rails 12*a* and 12*b* pivot on respective bolts 30*a* (not shown in FIG. 1) and 30*b* in the conventional manner of a folding step stool. A pair of folding spreaders 38*a* and 38*b* connect respective pairs of side rails 11*a* and 12*a*, and 11*b* and 12*b*, to each other and lock in an open position, as shown in FIG. 1. It was first thought that spreaders positioned near distal ends 17 and 19 might contribute to safety of the apparatus during use by stabilizing the footprint defined by the distal ends 17 and 19 of the side rails. However, the inventor has discovered that he believes employment of spreaders at these positions is generally disadvantageous. The principal reason for this belief is that it has been found to be desirable when using pairs of the stilts constructed according to the present invention to be able to insert one leg of one of the stilts into an area which is within the footprint of the other stilt. For example, when working near a corner, the wearer may wish to turn his or her left foot inward so that the distal end 19*a* of side rail 12*a* of the stilt on the user's left foot becomes positioned between side rails 11*b* and 12*b* of the stilt on the user's right foot. In this configuration, distal end 19*a* of side rail 12*a* is located within the footprint defined by the distal ends of the side rails of the stilt on the right foot. This allows the user to more freely position his or her feet and to move them closer together in certain working conditions.

The inventor believes that the best mode of practicing the present invention is to provide boot 25 made of a rubber-like material similar to that used to construct boots on water skis. Fairly rigid molded plastic material is also considered a desirable material for boot 25. The particular materials are not considered vital and only the qualities of strength and sufficient rigidity to normally maintain the boot in an open position so that the user may step directly into it are deemed important.

It is contemplated that the best mode of practicing the invention would be to provide two boots of differing sizes which may be alternately employed by users having different size feet. They may be selectively employed depending on the size of the user's foot combined with the bulk of the footwear he or she is wearing during use of the stilts.

As noted hereinabove, the characteristic foot axis 22 of head step platform 21 is preferably aligned so that it splits the middle between the pairs of side rails. It is also preferable that it be colinear with the foot insertion axis of boot 25, although it is only important that they be substantially parallel in embodiments of the present invention. This allows the user to step with ease from the top step 15*b* and insert his or her foot into boot 25 while placing the bottom of the user's foot or shoe on to the top of head step platform 21.

Figures 2, 3, 5:
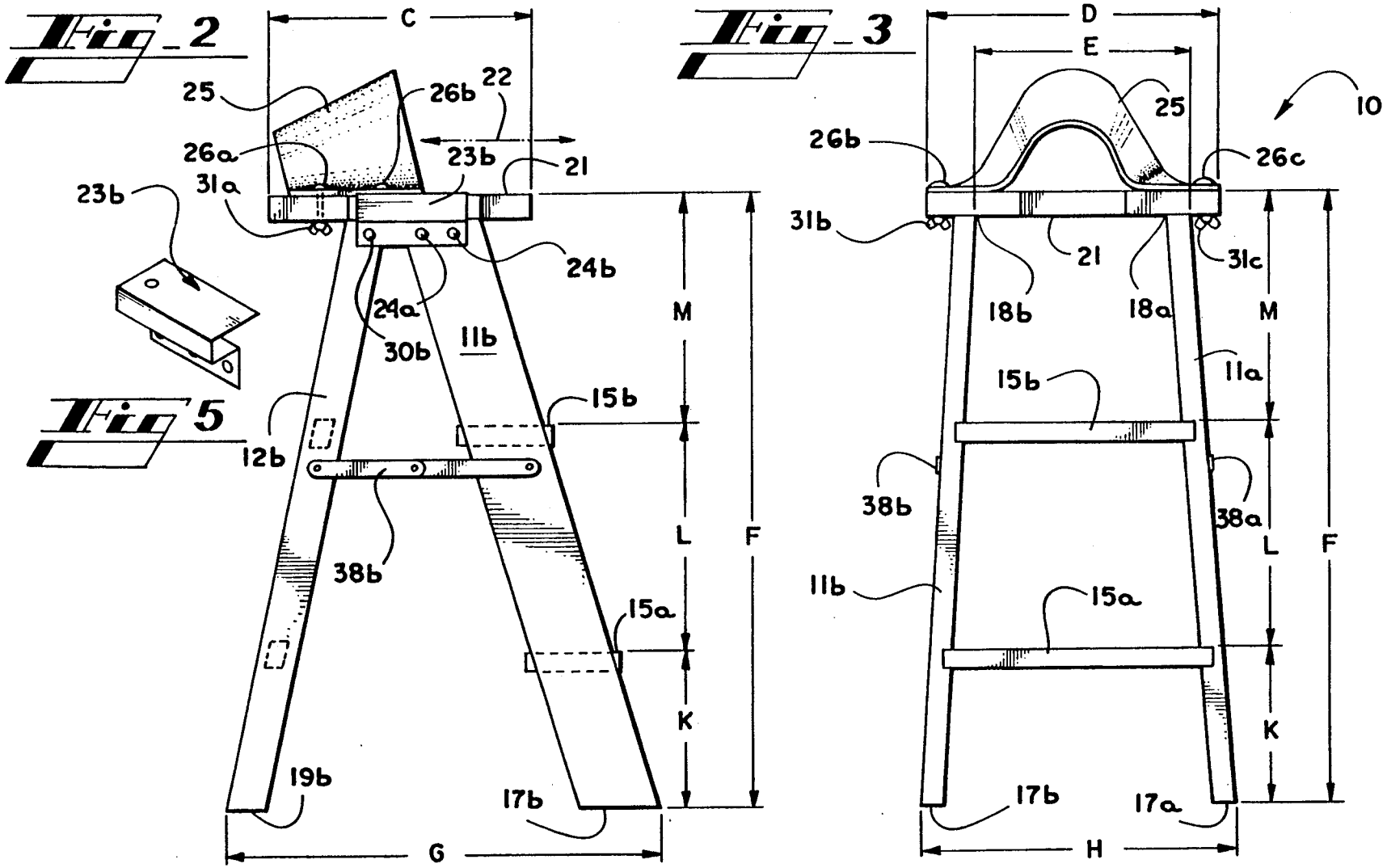
FIG. 2 is a left side elevational view of the preferred embodiment.
FIG. 3 is a front elevational view of the preferred embodiment.
FIG. 5 is a detailed drawing showing a pictorial representation of the bracket shown in FIG. 2.

Turning next to FIGS. 2 and 3, left side and front elevational views of the preferred embodiment are shown, respectively. Side rail 11*b* of the front side rail pair is permanently secured to head step platform 21 in any suitable manner. In the preferred embodiment, it is secured by bolts 24*a* and 24*b* which pass through bracket 23*b*. Alternately, an entire conventional head step frame from a step stool may be employed wherein head step platform 21 is secured to the head step area of the conventional stool structure with front side rail 11*b* being secured to the conventional head step frame.

As may be seen from inspection of FIGS. 1 and 2, side bracket 23*b*, which is also shown in detail in FIG. 5, is a stamped aluminum bracket which is a modified version of a bracket used to assemble a conventional wooden step stool. Front side rails 11 are permanently secured to head step platform 21 via bolts 24 and rear side rails 19 are pivotally mounted via bolts 30. The open position is defined by the locked extended position of spreader 38 and the point at which the rear portion of proximal end 20*b* contacts the under side of head step platform 21. Conventional step ladder assemblies in which a bracket employing a stop to define the limit of rotational movement of proximal ends 20 about the rotational axis defined by bolt 30*b* may also be employed. However, it is believed that employing an inexpensive pair of brackets such as brackets 23 is the preferable form of construction.

Boot 25 is through bolted, as described hereinabove, to the upper surface of head step platform 21. As noted above, the inventor believes the best mode of attaching the boot is to provide through bolts with wind nuts, such as nut 31*b* which engages bolt 26*b* as shown in FIG. 2. A corresponding wing nut attached to bolt 26*a* is not shown in FIG. 2 for clarity, although it should be understood that same is employed and would be visible if installed in the view shown in FIG. 2.

Figure 4:
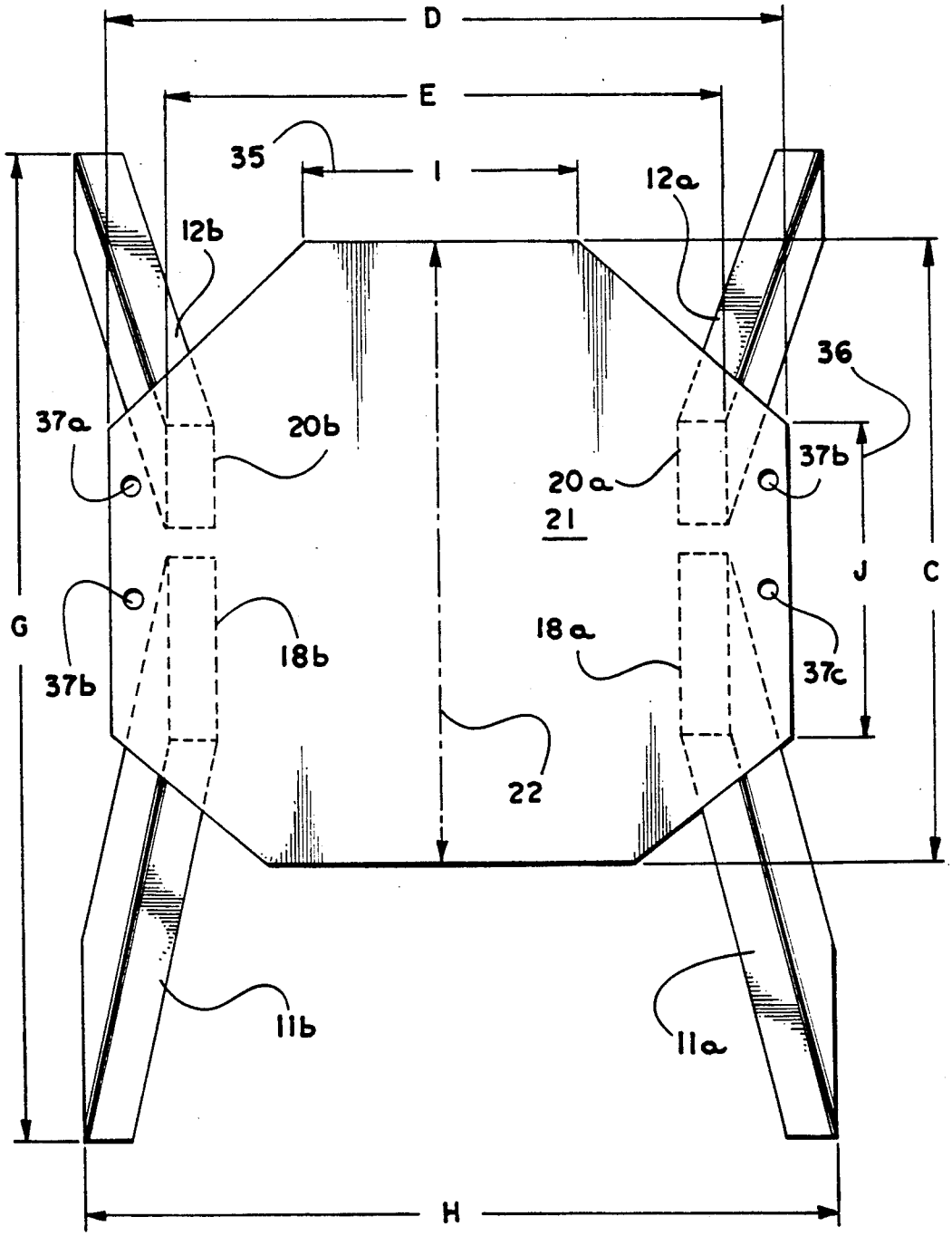
FIG. 4 is a top plan view of the head step platform of the preferred embodiment with the boot removed and showing the head step area defined by the side rails in phantom.

Turning next to FIG. 4, a top plan view of the head step platform of the preferred embodiment is shown. The location of proximal ends 18 and 20 of the two pairs of side rails are shown in phantom in FIG. 3. As is the case with FIG. 1, various dimensions of the preferred embodiment are shown on dimension lines in the drawing.

In FIG. 4, dimension lines 35 and 36 define a rectangular normal head step area for a step stool. Those skilled in the art will immediately appreciate that dimension lines 35 and 36 define the area that constitutes a conventional head step for conventional step stool constructed using side rail pairs similar to those used in the preferred embodiment. As may be seen in FIG. 4, head step platform 21 is extended along the direction of foot axis 22, and in particular, is extended toward the first pair of side rails that carry steps 15. In other words, it is extended with respect to the normal head step area in a direction toward the bottom of the drawing of FIG. 3. This extension provides the greatly increased stability of the entire structure. Indeed, it changes the structure from one for which it is relatively dangerous to stand on the head step, as users are conventionally warned not to do, into one where the elongated head step platform provides a stable area upon which to place one's foot and stand while working.

As is shown in FIG. 4, in the preferred embodiment the head step platform is elongated, with respect to the normal head step area, along both directions parallel to foot axis 22.

A plurality of through bolt holes 37 are provided through head step platform 21 to provide for securing of boot 25 as described hereinabove.

The preferred embodiment of the present invention is constructed principally of wood, with brackets 23 being of conventional construction from stamped aluminum. However, virtually any rigid material such as other metals, and even rigid plastics may be used to construct embodiments of the present invention.

It should be noted that the aforementioned extension of the head step platform with respect to the normal head step area is defined in terms of a normal size head step used on a step stool of conventional construction. Thus, it should be appreciated that embodiments of the present invention can be constructed wherein the side rails are significantly spaced apart along the direction of foot axis 22 and thus, the head step area defined by the outer edges of the proximal ends of the side rails will be sufficiently elongated to be within the scope of the present invention when a boot is attached thereto. The important aspect of the elongation of the head step platform is that it be elongated sufficiently to support substantially all of the foot of a normal size adult sheetrocker.

In FIGS. 2 through 4, various dimension lines showing dimensions of the preferred embodiment are labeled with letters c through m. These dimension lines indicate the sizes of various components in the preferred embodiment. While the inventor has experimented with various modifications to the ladder-like stilt devices described herein, the embodiment described herein constitutes what the inventor believes to be the best mode of carrying out the present invention. The following table shows the dimensions, in inches, of the preferred embodiment that the inventor believes to constitute the best mode. These are included for purposes of full disclosure of the best mode and are not to be taken as limiting of the scope of the present invention.

TABLE

| Dimension Line | Dimension in Inches |
|---|---|
| C | 10 |
| D | 11 |

TABLE -continued

| Dimension Line | Dimension in Inches |
|---|---|
| E | 9 |
| F | 23 |
| G | 16 |
| H | 12 |
| I | 4 |
| J | 5 |
| K | 6 |
| L | 8 |
| M | 9 |

As with all stilt and ladder-type devices, there is an element of danger involved in use, and some careful practice is required. However, it is the inventor's experience that it is much easier to learn to use embodiments of the present invention, and also easier to continue to use same, than conventional sheetrocker's stilts.

The foregoing has been a complete description of the preferred embodiment, and several alternatives thereto, of the present invention. It also fully discloses what the inventor believes to be the best mode of carrying out his invention. In view of the disclosure of the preferred embodiment and the alternatives described hereinabove, other embodiments of the present invention will suggest themselves to those skilled in the art. Therefore, the scope of the present invention is to be limited only by the claims below.

I claim:

1. Apparatus comprising in combination:

a first pair of side rails having at least one step extending therebetween and having characteristic distal and proximal ends;

a second pair of side rails having characteristic distal and proximal ends;

a head step platform elongated along the direction of a predetermined foot axis;

means connecting said proximal ends of said first and second pairs of side rails to said head step platform so that said foot axis extends between said first pair of side rails and between said second pair of side rails; and a boot defining a predetermined foot insertion axis and being connected to the upper surface of said head step platform so that said foot axis is substantially parallel to said foot insertion axis.

2. Apparatus as recited in claim 1 wherein:

said distal ends of first and second pairs of side rails define a predetermined footprint and the entire length of said head step platform along said foot axis is positioned over said footprint.

3. Apparatus comprising in combination:

means defining a step stool having a plurality of side rails, each of said side rails having a shoe end, a predetermined normal head step area, and means joining said plurality of side rails to said head step area so that said shoe ends of said plurality of side rails form a predetermined footing;

a head step platform elongated with respect to said normal head step area along a predetermined foot axis; and a boot defining a predetermined foot insertion axis connected to the upper surface of said head step platform so that said foot axis is substantially parallel to said foot insertion axis.

4. Apparatus comprising in combination:

a first pair of side rails having a plurality of steps extending therebetween spaced apart along the lengths thereof and having characteristic distal and proximal ends;

a second pair of side rails having characteristic distal and proximal ends and a plurality of braces extending therebetween;

a head step platform elongated along the direction of a predetermined foot axis;

means connecting said proximal ends of said first and second pairs of side rails to said head step platform so that the members of said first and second pairs of side rails form an acute angle and said foot axis extends between said first pair of side rails and between said second pair of side rails; and a boot defining a predetermined foot insertion axis and being connected to the upper surface of said head step platform so that said foot axis is substantially parallel to said foot insertion axis.

5. Apparatus as recited in claim 4 wherein:

said distal ends of first and second pairs of side rails define a predetermined footprint and the entire length of said head step platform along said foot axis is positioned over said footprint.

6. Apparatus as recited in claim 1 wherein said boot is an open boot.

7. Apparatus as recited in claim 3 wherein said boot is an open boot.

8. Apparatus as recited in claim 4 wherein said boot is an open boot.

9. Apparatus as recited in claim 1 wherein said second pair of side rails is pivotally attached to said head step platform at said proximal ends thereof.

10. Apparatus as recited in claim 3 wherein at least two of said plurality of side rails are pivotally attached to said head step platform.

11. Apparatus as recited in claim 4 wherein said second pair of side rails is pivotally attached to said head step platform at said proximal ends thereof.

* * * * *